US007735496B2

(12) United States Patent
Ellegard

(10) Patent No.: US 7,735,496 B2
(45) Date of Patent: Jun. 15, 2010

(54) HAIR ACCESSORY

(76) Inventor: Cheryl O. Ellegard, 6727 E. Exeter Blvd., Scottsdale, AZ (US) 85251

( * ) Notice: Subject to any disclaimer, the term of this patent is extended or adjusted under 35 U.S.C. 154(b) by 0 days.

(21) Appl. No.: 11/580,457

(22) Filed: Oct. 13, 2006

(65) Prior Publication Data

US 2008/0099035 A1 May 1, 2008

(51) Int. Cl.
*A45D 8/12* (2006.01)

(52) U.S. Cl. ..... 132/275

(58) Field of Classification Search ..... 132/273, 132/275, 276, 278, 280–282; D28/41, 42
See application file for complete search history.

(56) References Cited

U.S. PATENT DOCUMENTS 5,365,954 A * 11/1994 Rude ..... 132/275
5,697,387 A * 12/1997 Hanisco ..... 132/275
5,775,345 A * 7/1998 Chou ..... 132/278
2004/0237992 A1* 12/2004 Klug ..... 132/275
2005/0056298 A1* 3/2005 McRoberts ..... 132/276
2007/0175493 A1* 8/2007 Tandberg et al. ..... 132/275

* cited by examiner

*Primary Examiner*—Cris L Rodriguez
*Assistant Examiner*—Rachel R Steitz
(74) *Attorney, Agent, or Firm*—Knobbe Martens Olson & Bear LLP

(57) ABSTRACT

A hair clip according to one embodiment of the present invention has a top surface and a bottom surface and at least one hook connected to the bottom surface. The hook is configured such that it has an open end. A hair band can slide under the open end of the hook and fit securely inside the hook.

17 Claims, 9 Drawing Sheets

HAIR ACCESSORY

BACKGROUND

1. Field of the Invention

The present invention relates generally to the field of hair accessories and more particularly to a hair clip having a replaceable hair band.

2. Description of the Related Art

Hair clips are commonly used for styling, accessorizing, and/or securing the hair. Conventional hair clips generally include a decorative part designed for aesthetic reasons and an elastic band permanently attached to the decorative part. Elastic bands have a lifetime that is generally shorter than the lifetime of the decorative part of a hair clip and the bands often break easily. Because elastic bands do not last very long, most hair clips become unusable after a short period of time. Thus, even though the decorative part of the hair clip may still be in good condition, the hair clip may no longer be used because of a broken elastic band.

SUMMARY

What is needed, therefore, is a hair clip that provides more flexibility and lasts for a longer period of time.

These needs are satisfied by the invention which, in one embodiment includes a hair holding device comprising a decorative unit having a top surface and a bottom surface, the bottom surface having an opening therein and a first hook having a first end and a second end, wherein the first end is connected to the bottom surface and the second end is configured such that it can be removably inserted into the opening. In one embodiment, the hair holding device further comprises a band configured to be removably connected to the decorative unit.

Another embodiment of the invention includes a hair holding device comprising a decorative unit having a top surface and a bottom surface, the bottom surface having a first opening and a second opening therein, a first hook having a first end and a second end, a second hook having a third end and a fourth end, wherein the first end and the third end are connected to the bottom surface and the second end and the fourth end are configured such that they can be removably inserted into the first opening and second opening, respectively. Another embodiment of this hair holding device further comprises a band configured to be removably connected to the decorative unit. In yet another embodiment the band is configured to slide under the second end and the fourth end and fit inside openings formed between the first end and the second end and the third end and the fourth end. In another embodiment, the first end and the third end are adjacent next to each other and the second end and the forth end are adjacent next to each other. In yet another embodiment, at least one of the first or the second openings extends from the bottom surface to the top surface. In another embodiment, the hair holding device further comprises a cover unit configured to be securely attached to the top surface such that it conceals the surface of the at least one of the first or the second opening.

Yet another embodiment of the invention includes a hair holding device comprising a decorative unit having a top surface and a bottom surface, the bottom surface having a plurality of three or more openings therein and a plurality of three or more hooks having a first end and a second end, wherein the first ends are connected to the bottom surface and the second ends are configured such that each one of the second ends can be removably inserted into one of the plurality of the openings. In one embodiment this hair holding device further comprises a band configured to be removably connected to the decorative unit. In yet another embodiment, the band is configured to slide under the second ends and fit inside openings formed between the first ends and the second ends. In another embodiment, at least one of the openings extends from the bottom surface to the top surface. In yet another embodiment, the hair holding device further comprises a cover unit configured to be securely attached to the top surface such that it conceals the surface of the at least one of the openings.

Another embodiment of the invention includes a hair holding device comprising a decorative unit having a top surface and a bottom surface, a plurality one or more spring clips having a top element and a bottom element, the top element having a first end, wherein each of the bottom element is connected to the bottom surface and where in an undisturbed configuration at least a portion of each of the first ends touches at least a portion of the respective bottom element. In one embodiment, the first ends are configured such that they can be lifted off the bottom element to allow a band to slide under the first ends and into an opening formed between the top element and the bottom elements.

Yet another embodiment of the invention includes a hair holding device comprising a decorative unit having a top surface and a bottom surface, and at least one hook having a first end and a second end, wherein the first end is connected to the bottom surface and the second end is not connected to the bottom surface such that a gap is created between the second end and the bottom surface. In one embodiment, the hair holding device further comprises a band configured to be removably connected to the decorative unit. In yet another embodiment, the band is configured to slide through the gap and fit inside an opening formed between the first end and the second end.

DETAILED DESCRIPTION OF CERTAIN PREFERRED EMBODIMENTS

Figure 1A:
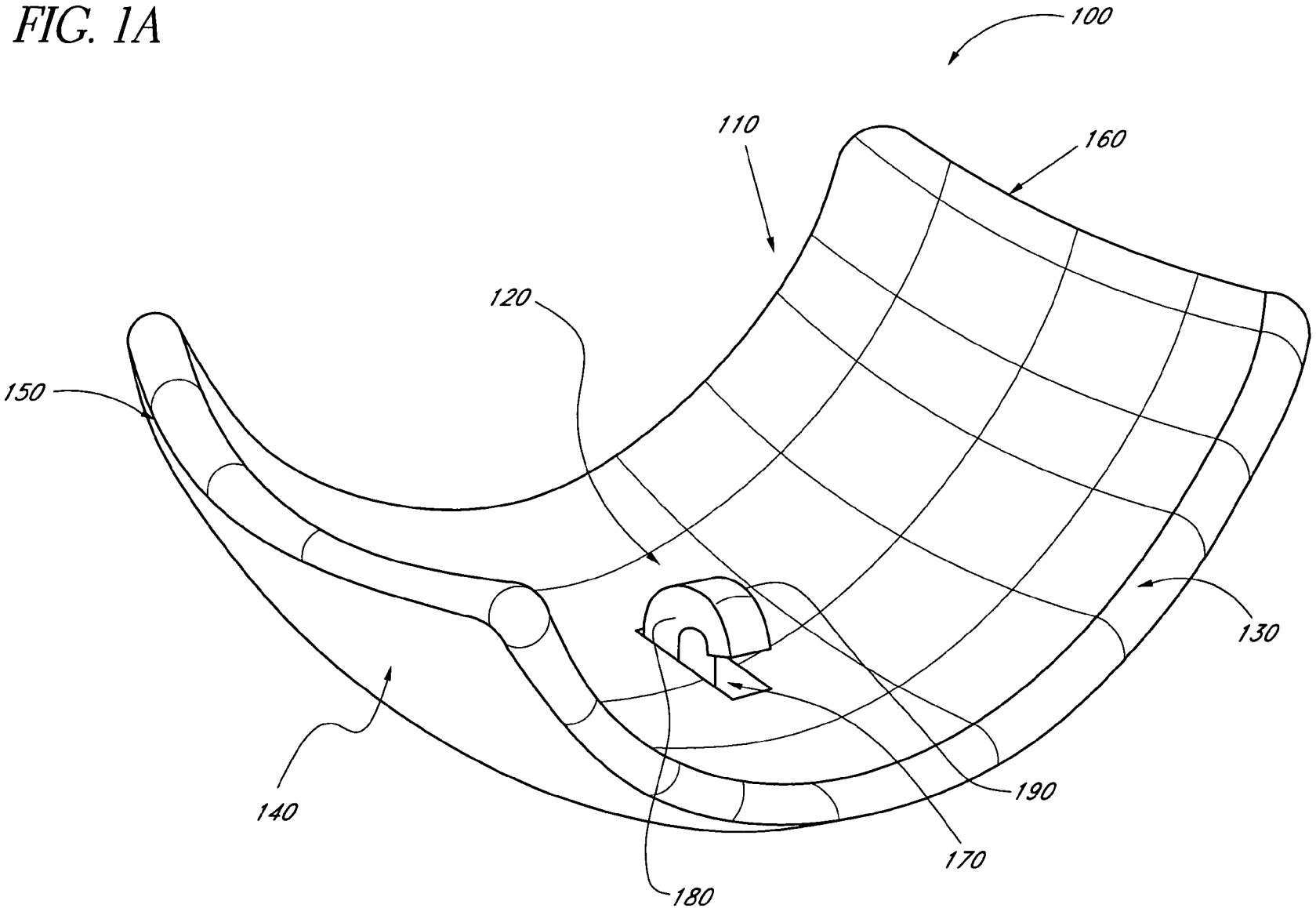
FIG. 1A illustrates a partial bottom view of a hair clip in accordance with one embodiment of the present invention.
Figure 2A:
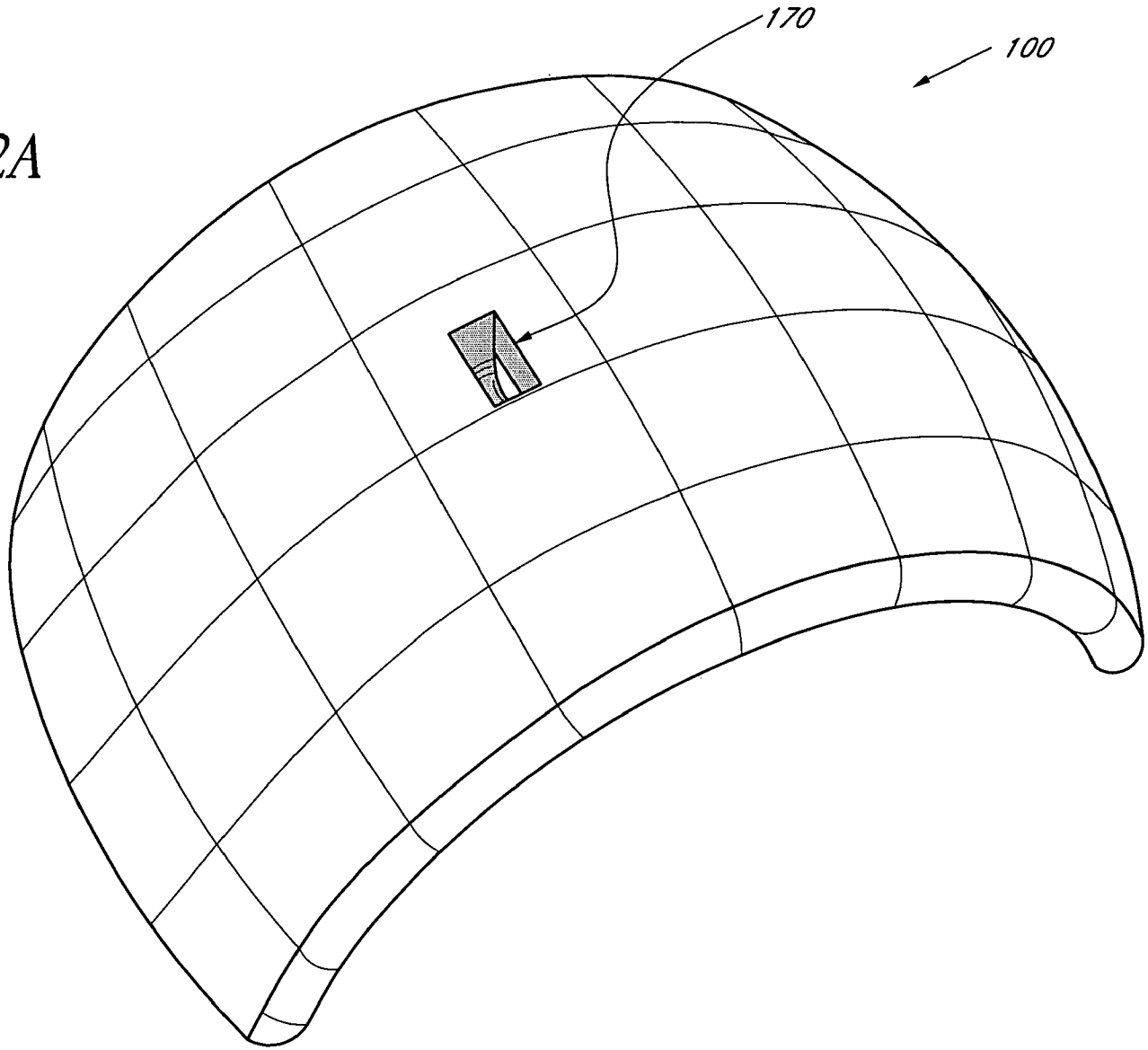
FIG. 2A illustrates a partial top view of a hair clip in accordance with one embodiment of the present invention.

FIG. 1A illustrates a bottom view of a hair clip 100 according to one embodiment of the present invention. The hair clip 100 generally includes a decorative unit 110 and a hook 120. As illustrated in FIG. 1A, the decorative unit 110 generally has a top surface 140 and a bottom surface 130. The bottom surface 130 may have an arcuate depression extending between two distal ends 150 and 160. The bottom surface 130 may also have an opening 170, generally located halfway between the two distal ends 150 and 160. As illustrated in FIG. 2A, the opening 170 may extend from the bottom surface 130 to the top surface 140. However, it should be noted that in some embodiments, the opening 170 need not be present or may be replaced by a recess area. The recess area may extend from the bottom surface 130 partially into the unit 110, but might not reach the top surface 140.

Figure 2B:
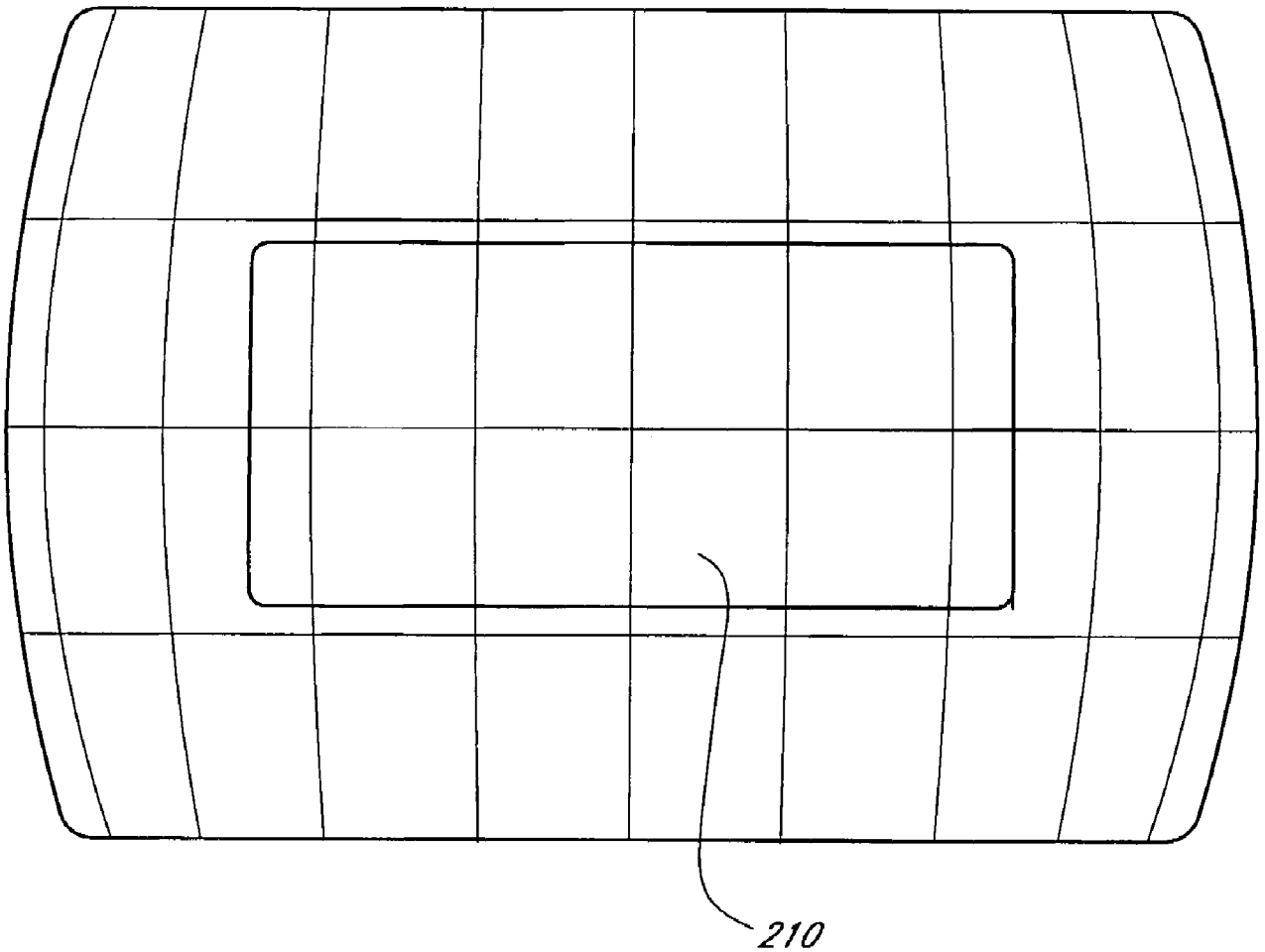
FIG. 2B illustrates a partial top view of a hair clip having a covering unit in accordance with one embodiment of the present invention.

When the opening 170 does extend from the bottom surface 130 to the top surface 140, a cover unit 210 may be placed on the top surface 140 such that it covers the opening 170, as illustrated in FIG. 2B. An adhesive may be used to secure the cover unit 210 to the top surface 140 of the unit 110. When adhesive is used, there may be a distance between the unit 210 and the top surface 140. This distance is generally filled with the adhesive. In one embodiment the distance is about 0.01". In other embodiments, the distance is between 0.005" and 0.01". In yet other embodiments, the distance is between 0.01" and 0.02". Other embodiments are also possible.

Figure 2C:
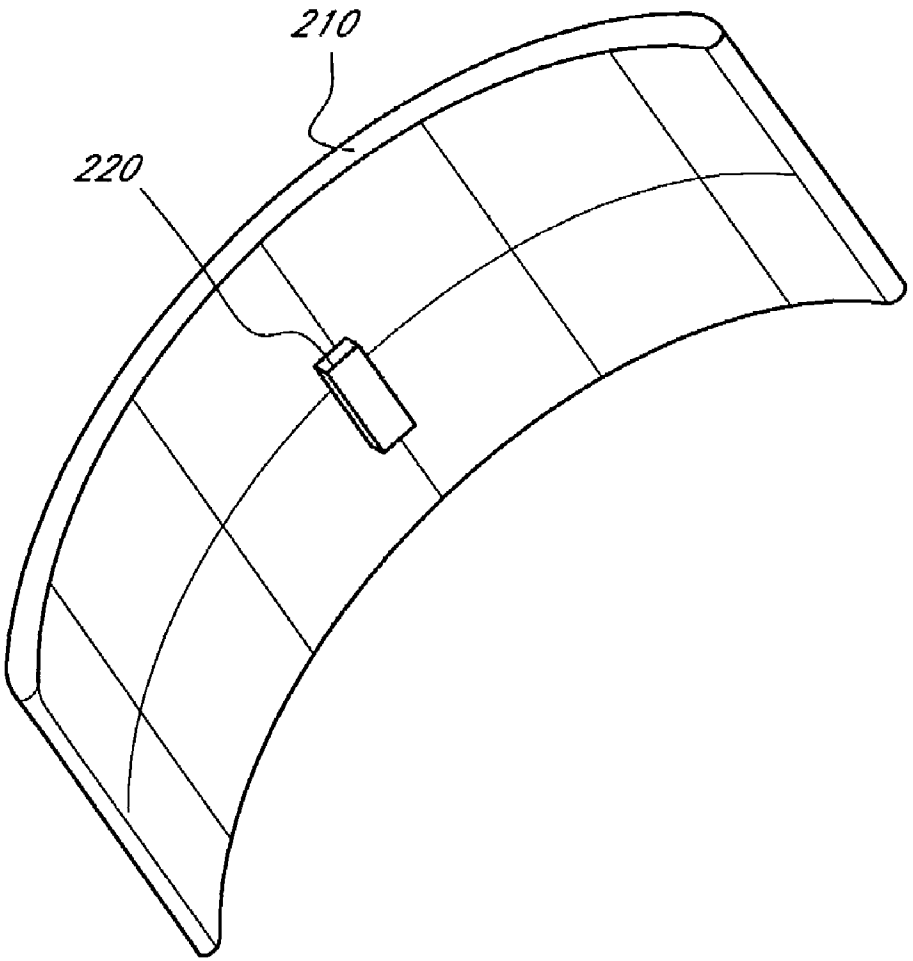
FIG. 2C illustrates a partial bottom view of the cover unit of FIG. 2B in accordance with one embodiment of the present invention.

Other methods may also be used to securely attach the cover unit 210 to the top surface 140. For example, as illustrated in FIG. 2C, the cover unit 210 may have a protrusion 220 that can fit into the opening 170. The protrusion 220 may extend only partially into the opening such that it does not interfere with the hook 120, when the hook is inserted into the opposite side of the opening 170. An adhesive may be used to permanently secure the protrusion 220 partially into the opening 170. A variety of other configurations are also possible. For example, the cover unit 210 may be integrally molded to the unit 110.

In one embodiment, the unit 110 is constructed of a plastic material, such as polypropylene. Use of plastic is advantageous, because plastic is generally a low cost material and manufacturing products out of plastic is relatively easy. The unit 110 is shaped in a variety of different configurations. For example, in some embodiments, the unit 110 may be shaped as a flat rectangle, flat circle, flat triangle, or any other flat geometrical shape. In some configurations, the unit 110 is shaped in non-geometrical configurations, such as flowers and the like. In certain embodiments, the unit 110 has a depression or a curvature. The curvature can be in the horizontal, the vertical, or both the horizontal and the vertical directions.

Furthermore, in certain embodiments the unit 110 may be constructed of materials other than plastic, such as various metals, composites, leather, wood, and any other suitable material. Other configurations are also possible.

Figure 1B:
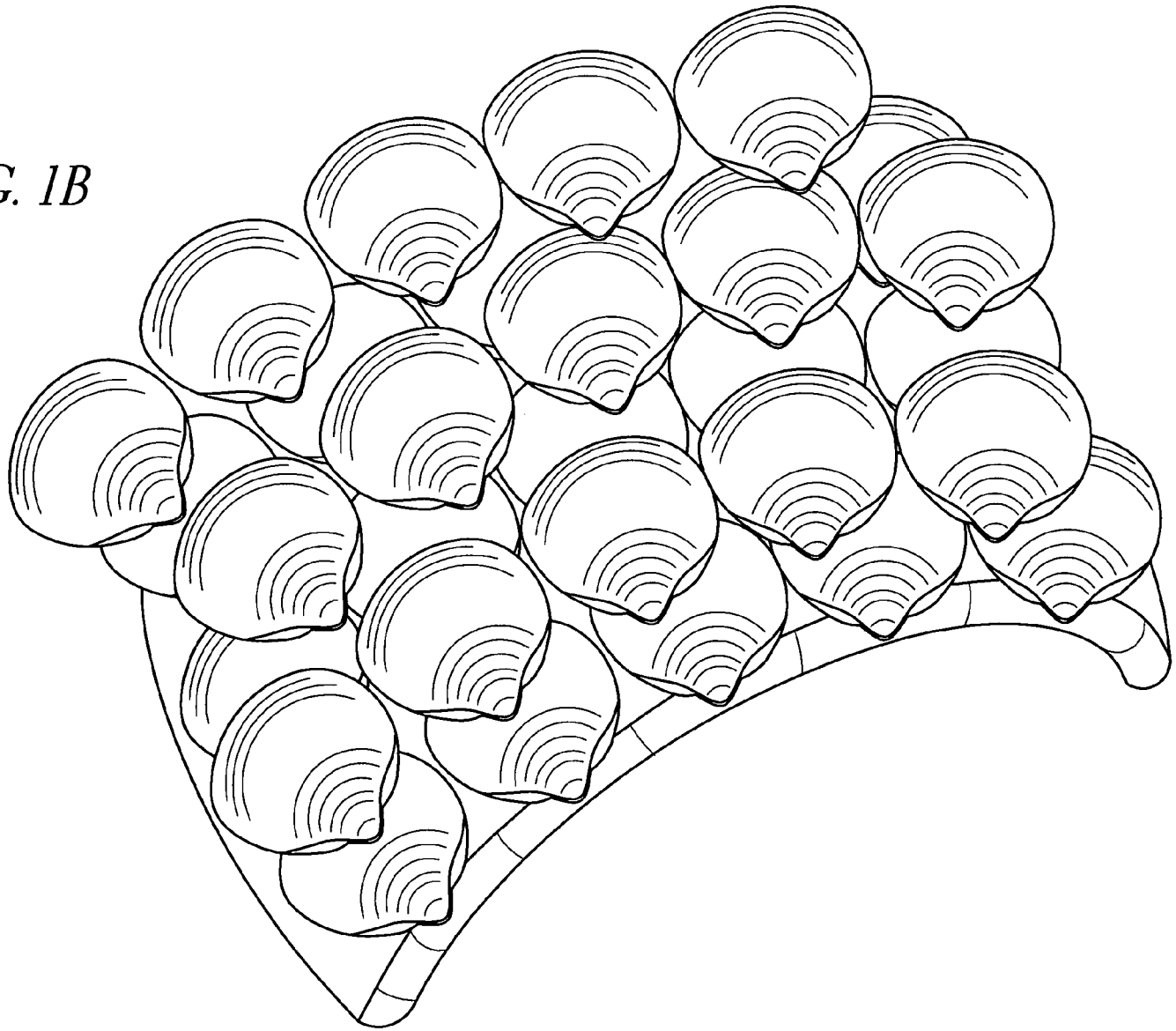
FIG. 1B illustrates a partial top view of a hair clip having decorative sea shells in accordance with one embodiment of the present invention.

In certain embodiments, the top surface 140 of the unit 110 may be adorned with a variety of decorative items. For example, sea shells, leather, various fabrics, cloths, and/or a variety of animal skins such as reptile skin, may be used to cover either partially or completely the top and/or the bottom surfaces of the unit 110. In other embodiments, the top surface 140 may be painted and/or carved. In yet other embodiments, sea shells are used to form a variety of different designs on the top surface 140 of the unit 110. One example of such a design is illustrated in FIG. 1B. As shown in FIG. 1B, a number of sea shells having substantially the same shape and size are attached to the top surface 140 of a hair clip. Other embodiments are also possible. For example, in some embodiments, sea shells of different shapes and/or sizes are used.

In one embodiment the top surface 140 is adorned with fabric. For example, a piece of fabric is used to cover all or some parts of the top surface 140. The fabrics can have a variety of different colors and/or designs. The various colors and designs of the fabric give users the ability to match their hair clips with their outfits. For example, users can choose hair clips that have the same color and/or design as their purses and/or their shoes. In one embodiment, the piece of fabric is cut such its shape matches the shape of the top surface 140 and is permanently attached to the top surface 140 by a variety of methods known in the art. For example, the piece of fabric may be attached to the top surface 140 by an adhesive. In other embodiments, the fabric has a shape that is different than the shape of the top surface 140 and the fabric is used to create a variety of different designs and decorations on the top surface 140. For example, the fabric may be shaped such that it covers a central portion of the top surface 140, while other portions of the top surface 140 are adorned with other decorative objects. A variety of other configurations are also possible.

In one embodiment, the fabric covers both the top and the bottom surfaces of the unit 110. In this embodiment, the fabric is wrapped around the unit 110. Alternatively, separate pieces of fabric may be used to cover the top and bottom surfaces. In certain embodiments, the fabric is sewn around the unit 110. In other configurations, the fabric is removably attached to the hair clip 100 such that a user can remove the fabric. In this embodiment, the users can exchange a current fabric with another one. For example, users may change the fabrics to match the color of the hair clips with their outfits.

Referring back to FIG. 1A, a hook 120 which is generally constructed of the same material as the unit 110, is integrally connected to the unit 110. The hook 120 generally has a first end 180 and a second end 190. As illustrated, the first end 180 is integrally connected to the bottom surface 130. The second end 190 is configured such that it is not connected to the unit 110. Thus, a gap is created between the bottom surface of the second end 190 and the opening 170.

In other embodiments, the second end 190 is configured such that it is not permanently connected to the unit 110, but can be removably connected to the unit 110, when inserted into the opening 170. Thus, the hook 120 can have an open position when the second end 190 is not inserted into the opening 170 and a closed position when the second end 190 is inserted into the opening 170. After being inserted into the opening 170, the second end 190 can be pulled up to place the hook 120 into an open position again. In yet other embodiments, the hook 120 may have threads that are complementary to threads in the opening 170 and can be twisted into the opening 170 for a closed position and twisted out of the opening 170 for an open position.

In one embodiment, the bottom surface 130 does not have an opening 170. In this embodiment, the first end 180 of the hook 120 is permanently attached to the bottom surface 130 and the second end 190 is in a suspended open position.

Figure 1C:
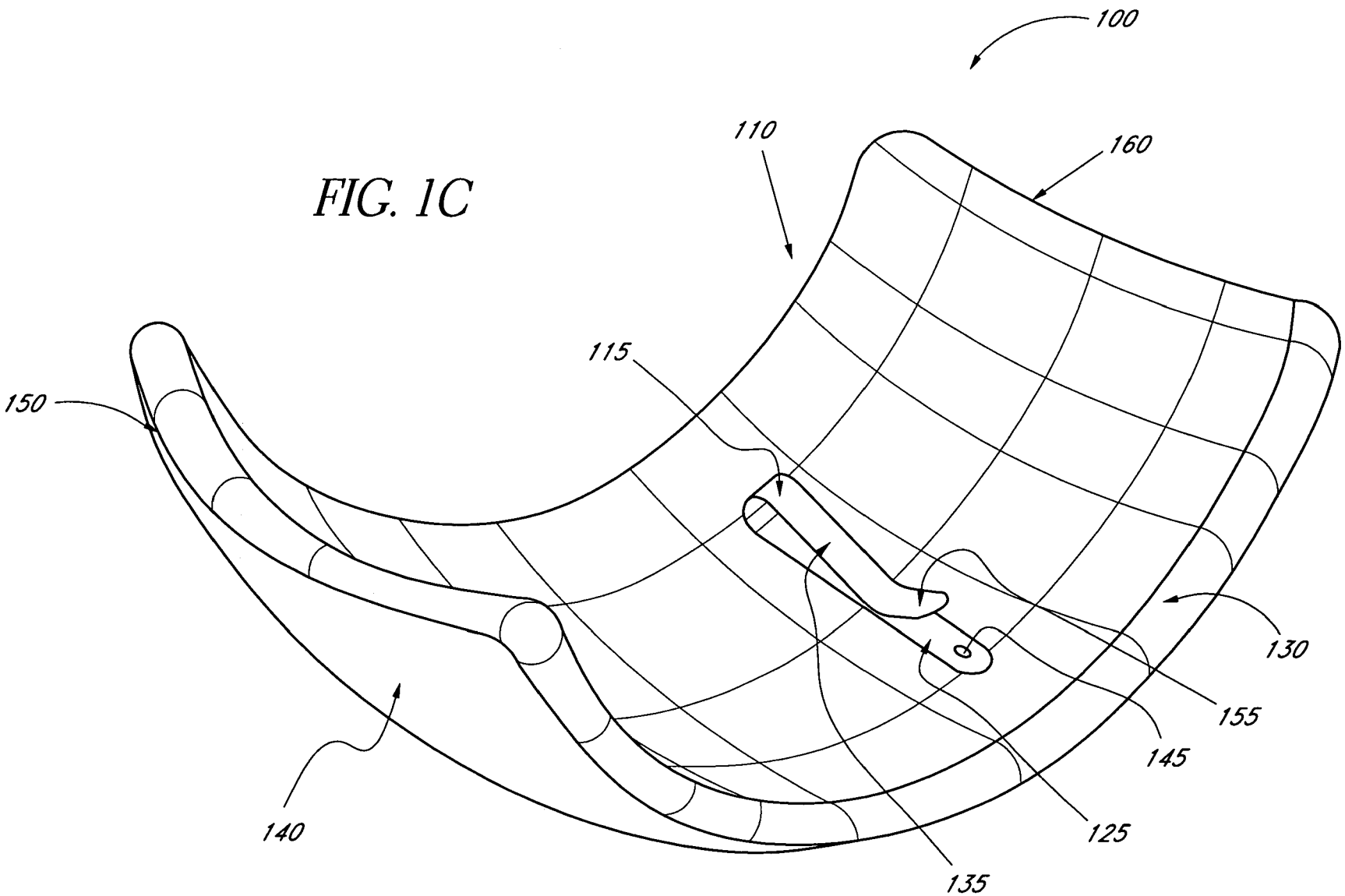
FIG. 1C illustrates a partial bottom view of a hair clip having a spring clip in accordance with one embodiment of the present invention.

In certain embodiments, the hook 120 could be replaced by a spring clip 115, as illustrated in FIG. 1C. The spring clip 115 can have a bottom element 125 and a top element 135, where the bottom element 125 is attached to the bottom surface 130 of the unit 110. The bottom element 125 may have an opening 145 through which the bottom element 125 can be screwed to the bottom surface 130. In other embodiments, the bottom element 125 can be imbedded or integrally molded into the bottom surface 130. In yet other embodiments, the bottom element 125 can be bonded to the bottom surface 130 by for example, an adhesive material, or other methods known in the art. Other configurations are also possible.

The clip 115 is generally configured such that in an undisturbed configuration, at least a portion of an end 155 of the top element 135 almost always touches a potion of the bottom element 125. The end 155 is not, however, permanently attached to the bottom element 125 and is configured such that it can be lifted up, when desired. For example, the end 155 can be lifted up from the bottom element 125 to allow a hair band to slide under the end 155 and into the opening formed between the top element 135 and the bottom element 125. Other alternative embodiments are also possible. For example, the hook 120 can be replaced by other highly resilient metal devices.

Figure 3:
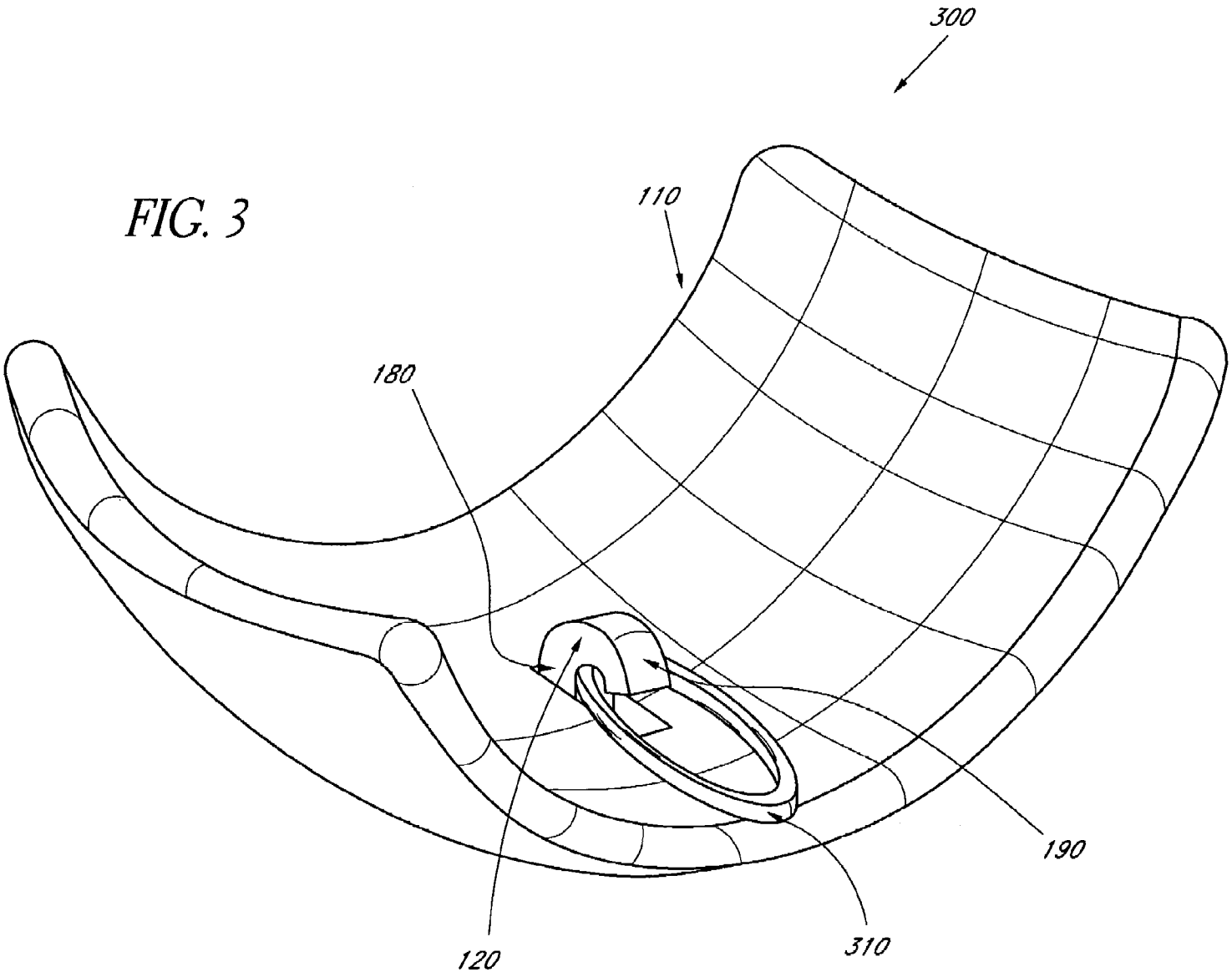
FIG. 3 is a partial bottom view of a hair clip having a hair band in accordance with one embodiment of the present invention.

In certain embodiments, as illustrated in FIG. 3, a hair clip 300 includes a unit 110, a hook 120, and a band 310. The band 310 is generally an elastic band used for holding the hair. The band 310 can slide under the gap created between the bottom surface of the second end 190 and the opening 170 and fit inside the opening between the first end 180 and the second end 190 of the hook 120. The band 310 can also be removed from the unit 110 simply by pulling the band 310 towards the gap and away from the hook 120.

In embodiments, where the hook 120 has an open and a closed position, the band 310 can slide under the second end 190 and fit inside the opening between the first end 180 and the second end 190, when the hook 120 is in the open position. The second end 190 can then be inserted into the opening 170 to place the hook 120 in the closed position and ensure that the band 310 is securely attached to the hair clip 300. The hook 120 can be opened again to remove the band 310.

Thus, a user can exchange the band 310 by opening the hook 120 and/or pulling the band away from the hook 120 and replacing a current band 310 with a different band. Users may desire to exchange the current band 310 with a different band to replace a current broken band, change the color of the band, or replace a band with a band of different size or texture. For example, a particular hair band may be too small and/or too tight, or too large and/or too loose for a particular user's hair. Additionally, some hair bands include a metal piece which can cause hair damage by pulling or tangling the hair. The hair clip 300 gives users the ability to choose a hair band according to their own taste and desire.

Furthermore, elastic hair bands generally have a short lifetime relative to the unit 110. When the elastic hair band of a prior art hair clip brakes, generally the entire hair clip becomes unusable even though the decorative part of the hair clip may still be in perfect condition. Because of the short life of the elastic band and the resultant short life of the entire hair clip, hair clip manufacturers of prior art hair clips are generally forced to offer their hair clips at relatively low prices. The low prices do not permit manufacturers to allocate a lot of time and/or money to accessorizing and/or decorating an average hair clip. The hair clip of the preferred embodiment of the present invention eliminates these problems, by enabling the users to replace broken hair bands and thus extending the lifetime of an average hair clip.

Figure 4:
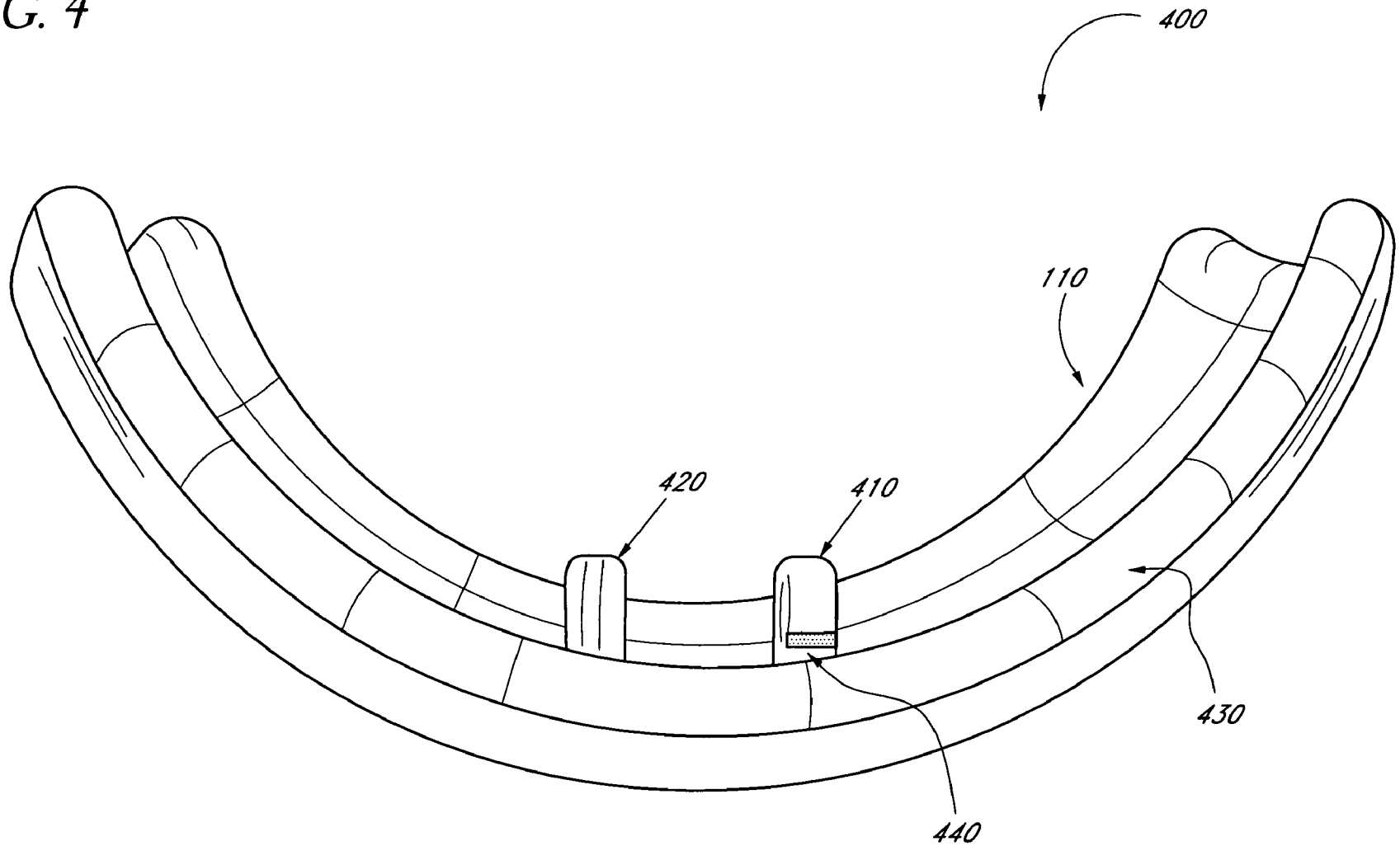
FIG. 4 is a partial bottom view of a hair clip having two hooks in accordance with one embodiment of the present invention.

FIG. 4 illustrates a hair clip 400 according to another embodiment of the present invention. The hair clip 400 includes a decorative unit 110 and two hooks 410 and a 420. This configuration is advantageous in that it stabilizes the band and causes it to hold the hair more securely. The hooks 410 and 420 are generally placed on the bottom surface 430 of the unit 110 and are placed such that they are generally close to each other. Furthermore, the hooks 410 and 420 may be positioned such that the permanently connected end of each hook is adjacent to the open end of the other hook.

In certain embodiments, each of the hooks 410 and 420 may have an open and a close position. Thus, the open ends of each of the hooks 410 and 420 can be removably inserted into openings 430 (not shown) and 440 (not shown) that correspond to the hooks 410 and 420. Therefore, a band can slide under the open end of the hooks 410 and 420 and fit inside the openings formed between the permanently connected ends and the open ends of the hooks 410 and 420. In other embodiments, the hooks 410 and 420 do not have closed positions, as discussed above with respect to hook 120 of FIG. 1A.

Figure 5:
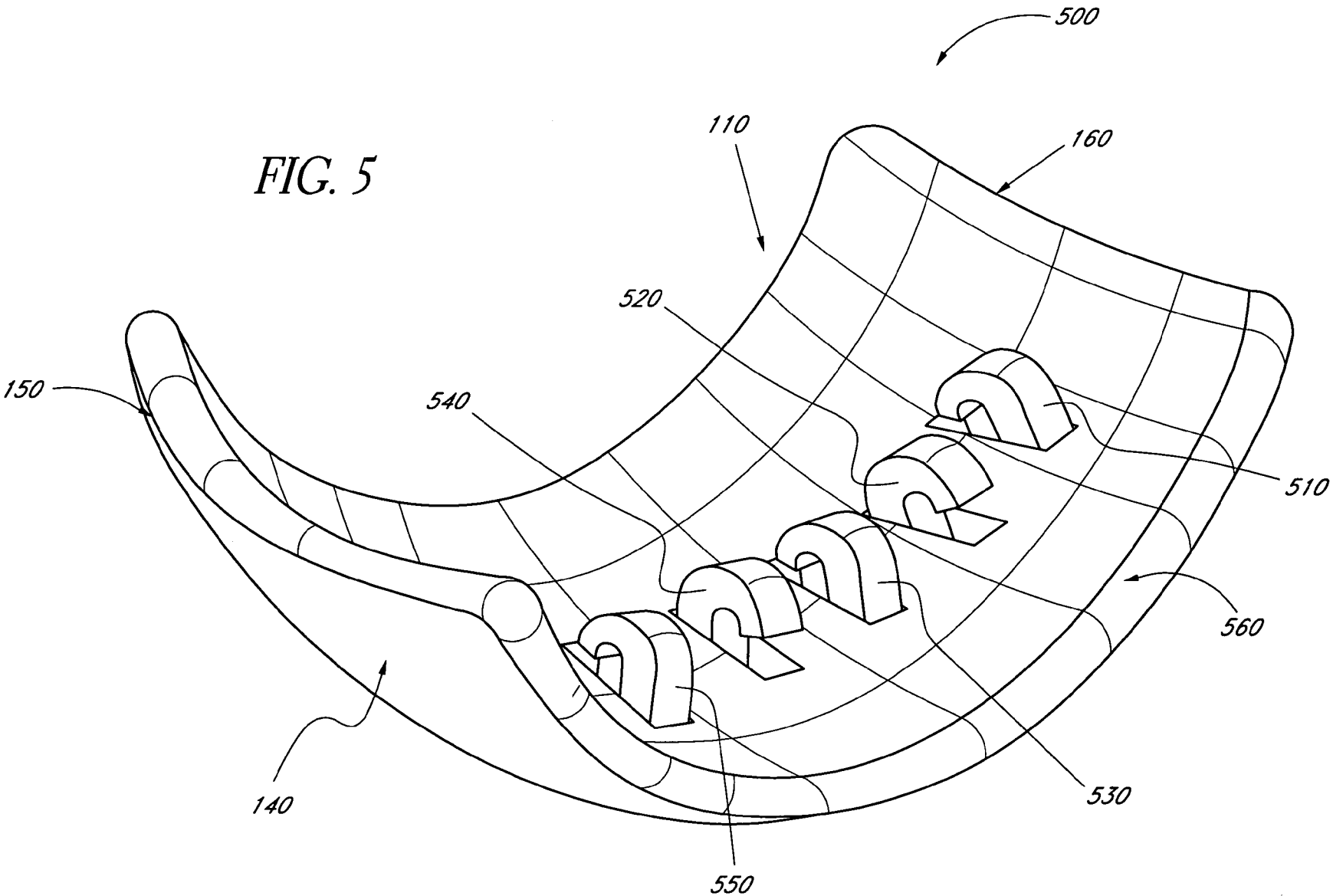
FIG. 5 is a partial bottom view of a hair clip having five hooks in accordance with one embodiment of the present invention.

Other configurations are also possible. For example, more than two hooks may be placed on the bottom surface of the unit 110, as illustrated in FIG. 5. As shown in FIG. 5, a hair clip 500 may include five hooks 510, 520, 530, 540, and 550. The hooks 510-550 are generally placed close to each other on a bottom surface 560 of the hair clip 500 and are positioned such that the permanently connected end of each hook is adjacent to the open end of another hook. A band can slide under the open ends of the hooks 510-550 and into the openings formed between the permanently connected ends and the open ends of each of the hooks 510-550.

In certain embodiments, the hooks 510-550 may have an open and a closed position. Thus, the hooks may be opened by pulling up and/or twisting one end of the hooks that is not permanently connected to the bottom surface, and the hooks can be closed by pushing in or twisting the open ends.

Although this invention has been disclosed in the context of certain preferred embodiments, it will be understood by those skilled in the art that the present invention extends beyond the specifically disclosed embodiment to other alternative embodiments and/or uses of the invention and obvious modifications and equivalents thereof. In particular, while the present hair accessory has been described in the context of a particularly preferred embodiment, the skilled artisan will appreciate, in view of the present disclosure, that certain advantages, features and aspects of the hair accessory may be realized in a variety of other devices. Additionally, it is contemplated that various aspects and features of the invention described can be practiced separately, combined together, or substituted for one another, and that a variety of combination and sub-combinations of the features and aspects can be made and still fall within the scope of the invention. Thus, it is intended that the scope of the present invention herein disclosed should not be limited by the particular disclosed embodiment described above, but should be determined only by a fair reading of the claims that follow.

What is claimed is:

1. A hair holding device comprising:

a decorative unit having a top surface and a bottom surface, the bottom surface extending between two distal ends, the bottom surface defining an arcuate depression between the two distal ends, the bottom surface having a first opening and a second opening therein;

a first hook being positioned between the two distal ends of the decorative unit, the first hook having a first end and a second end; and a second hook being positioned between the two distal ends of the decorative unit, the second hook having a third end and a fourth end;

the hooks having an open position, wherein the first end and the third end are permanently connected to the bottom surface and the second end and the fourth end are not permanently connected to the bottom surface such that gaps are created between the second end and the first opening and between the fourth end and the second opening;

the hooks having a closed position, wherein the second end and the fourth end are removably inserted into the first opening and second opening, respectively.

2. The hair holding device of claim 1, further comprising a band configured to be removably connected to the decorative unit.

3. The hair holding device of claim 2, wherein the band is configured to slide under the second end and the fourth end and fit inside openings formed between the first end and the second end and the third end and the fourth end.

4. The hair holding device of claim 1, wherein the first end and the third end are adjacent next to each other and the second end and the fourth end are adjacent next to each other.

5. The hair holding device of claim 1, wherein at least one of the first or the second openings extends from the bottom surface to the top surface.

6. The hair holding device of claim 5, further comprising a cover unit configured to be securely attached to the top surface such that it conceals the surface of the at least one of the first or the second openings.

7. A hair holding device comprising:

a decorative unit having a top surface and a bottom surface, the bottom surface extending between two distal ends, the bottom surface defining an arcuate depression between the two distal ends, the bottom surface having a plurality of three or more openings therein; and a plurality of three or more hooks being positioned between the two distal ends of the decorative unit, the hooks having a first end and a second end;

the hooks having an open position, wherein the first ends are permanently connected to the bottom surface and the second ends are not permanently connected to the bottom surface such that gaps are created between the second ends and the openings of the bottom surface; and the hooks having a closed position, wherein each one of the second ends is removably inserted into one of the plurality of said openings.

8. The hair holding device of claim 7, further comprising a band configured to be removably connected to the decorative unit.

9. The hair holding device of claim 8, wherein the band is configured to slide under the second ends and fit inside openings formed between the first ends and the second ends.

10. The hair holding device of claim 7, wherein at least one of said openings extends from the bottom surface to the top surface.

11. The hair holding device of claim 10, further comprising a cover unit configured to be securely attached to the top surface such that it conceals a surface of the at least one of the openings.

12. A hair holding device comprising:

a decorative unit having a top surface and a bottom surface; the bottom surface extending between two distal ends, the bottom surface defining an arcuate depression between the two distal ends, the bottom surface having a proximal end and a first opening and a second opening between the two distal ends; and a first and a second hook being positioned between the two distal ends of the decorative unit, each hook having an open end, and a permanently connected end;

wherein the permanently connected ends are connected to the bottom surface and the open ends are not connected to the bottom surface such that gaps are created between the open ends and the openings of the bottom surface;

wherein the hooks are positioned such that the permanently connected end of the first hook is adjacent to the open end of the second hook; the first hook configured to receive a removable band on the proximal end; the second hook configured not to receive a removable band on the proximal end.

13. The hair holding device of claim 12, further comprising a band configured to be removably connected to the decorative unit.

14. The hair holding device of claim 13, wherein the band is configured to slide through the gaps and fit inside openings formed between the permanently connected ends and the open ends of the hooks.

15. A hair holding device comprising:

a decorative unit having a top surface and a bottom surface; the bottom surface extending between two distal ends, the bottom surface defining an arcuate depression between the two distal ends, the bottom surface having a proximal end and openings between the two distal ends; and a plurality of three or more hooks being positioned between the two distal ends of the decorative unit, each hook having an open end, and a permanently connected end;

wherein the permanently connected ends are connected to the bottom surface and the open ends are not connected to the bottom surface such that gaps are created between the open ends and the openings of the bottom surface;

wherein the hooks are positioned such that the permanently connected end of each hook is adjacent to the open end of another hook.

16. The hair holding device of claim 15, further comprising a band configured to be removably connected to the decorative unit.

17. The hair holding device of claim 16, wherein the band is configured to slide through the gaps and fit inside openings formed between the permanently connected ends and the open ends of each hook.

* * * * *